United States Patent [19]

Kuhn

[11] 4,307,860

[45] Dec. 29, 1981

[54] RAILROAD GRADE CROSSING CONSTANT WARNING PROTECTION SYSTEM

[75] Inventor: John J. Kuhn, Allison Park, Pa.

[73] Assignee: American Standard Inc., Swissvale, Pa.

[21] Appl. No.: 62,090

[22] Filed: Jul. 30, 1979

[51] Int. Cl.[3] ..... B61L 29/28

[52] U.S. Cl. ..... 246/128; 246/125

[58] Field of Search ..... 246/34 R, 34 CT, 125, 246/128, 129, 130

[56] References Cited

U.S. PATENT DOCUMENTS 3,333,096 7/1967 Ohman et al. ..... 246/130 R X
3,734,434 5/1973 Smith ..... 246/125
3,951,364 4/1976 Sibley ..... 246/34 CT
3,977,634 8/1976 Smith ..... 246/128

*Primary Examiner*—Patrick R. Salce
*Assistant Examiner*—Reinhard J. Eisenzopf
*Attorney, Agent, or Firm*—J. B. Sotak

[57] ABSTRACT

A train detection system for protecting a railroad highway crossing having an a.c. transmitter center-feeding voltage signals into the track rails and having a receiver including at least a pair of coils located on opposite sides of the crossing and disposed adjacent the track rails for defining an island zone and for inductively picking up a.c. signals when the island zone is unoccupied and determines the time of arrival of a train at the crossing.

10 Claims, 1 Drawing Figure

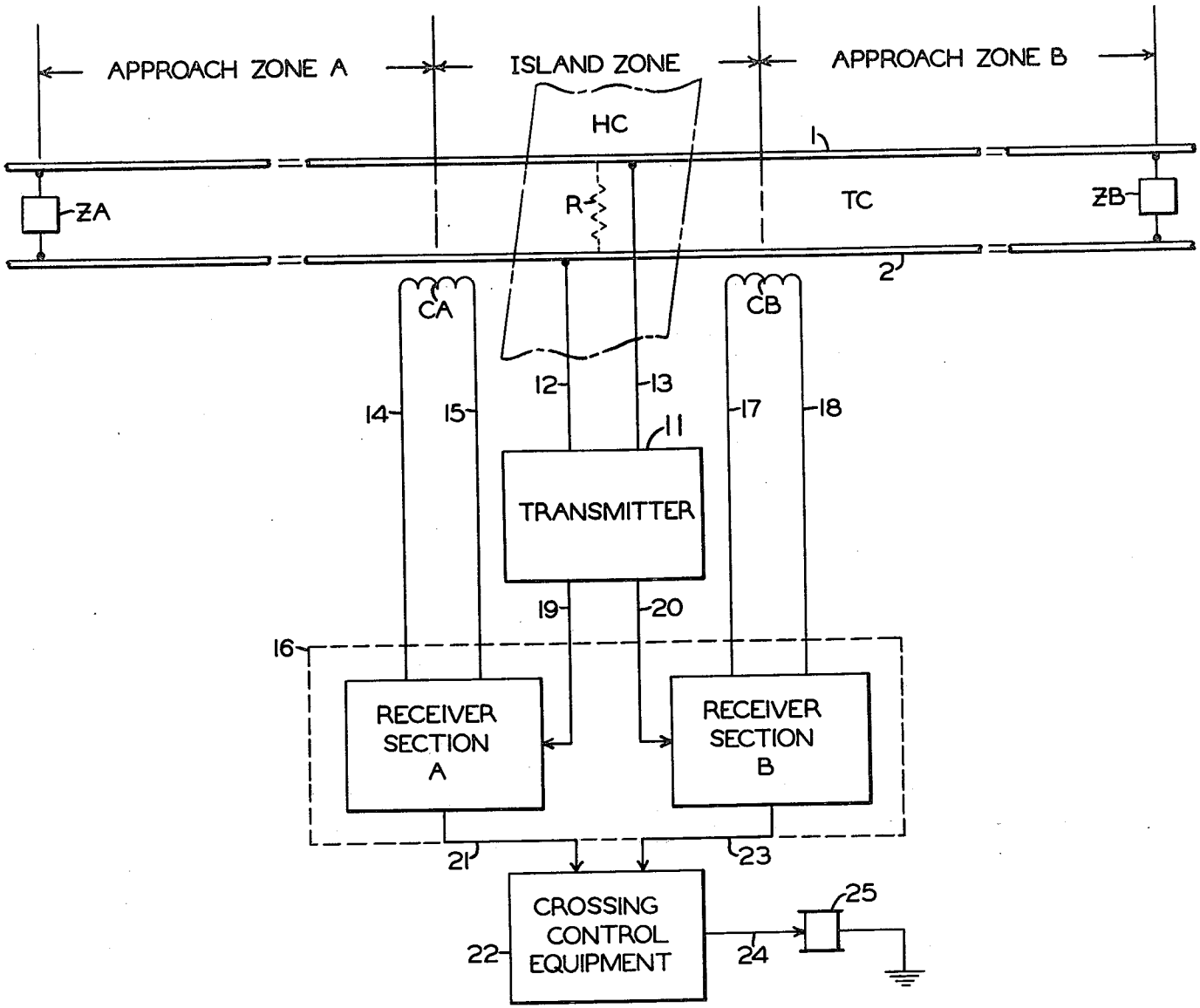
APPROACH ZONE B
ISLAND ZONE
APPROACH ZONE A
ZB
ZA
TC
HC
R
1
2
CB
CA
13
12
14
15
17
18
11
TRANSMITTER
19
20
RECEIVER SECTION B
RECEIVER SECTION A
16
21
23
CROSSING CONTROL EQUIPMENT
22
24
25

RAILROAD GRADE CROSSING CONSTANT WARNING PROTECTION SYSTEM

FIELD OF THE INVENTION

This invention relates to a train motion monitor system and, more particularly, to a constant warning device for railway highway crossings for independently monitoring train movement in each approach zone and for precisely defining an island zone.

BACKGROUND OF THE INVENTION

In previous railroad grade crossing protection systems for detecting and/or monitoring approaching trains, it was generally common practice to employ one of two techniques for obtaining the track parameters which controlled the highway warning apparatus. The first method employed an arrangement wherein a constant amplitude alternating current was transmitted and introduced into the track rails at the crossing location. The location of an approaching train and an indication of its velocity was obtained by measuring the amplitude of the voltage developed in the track circuit and the rate of change of the developed voltage. The second method involves incorporating the track circuit in a frequency determining network of an electronic oscillator. Thus, the reactance and resistance of the track circuit establish the frequency of oscillation. The frequency is constantly monitored and any frequency change is automatically adjusted to maintain the frequency constant. Thus, the rate of the frequency adjustments is detected to provide an indication of any train motion in the track circuit. It has been found that the existing motion monitors or detectors are possessed of several inherent shortcomings. For example, the monitoring apparatus is directly wire-connected to the track rails so that loading of the track circuit results in the desensitization of the motion detection. In the case of a center-fed track circuit, the reflected track impedance is equivalent to the product of the impedances of the two approach zones divided by their sum. Thus, at low ballast conditions, the measurement of the change in impedance of one approach zone is relatively difficult due to the loading of the other approach zone. Further, the sensitivity is adversely effected by the circuit being loaded by the lumped ballast resistance which occurs at the crossing area due to the accumulation or buildup of mud, salt, cinders, and other foreign substances which takes place during the winter season. In addition, the prior art motion detectors are susceptible to interference and inaccurate train prediction in coded track territory which causes alternate loading and unloading of the track circuit. Thus, the impedance presented to a previous continuous monitoring apparatus is in a state of constant flux so that the distance and velocity of an approaching train, which are functions of the value and rate of change of the track impedance, are unpredictable.

OBJECTS OF THE INVENTION

Accordingly, it is an object of this invention to provide a new and improved motion monitor device for a railroad highway crossing.

Another object of this invention is to provide a new highway crossing warning system for detecting the presence of a train in a track circuit.

A further object of this invention is to provide a railroad crossing protection arrangement employing a center-fed track circuit which provides bidirectional approaches and an island zone without the use of an island track circuit.

Yet another object of this invention is to provide a railroad highway crossing system having a center-fed transmitter connected to the track rails and having a pair of spaced coils disposed adjacent the track rails for defining an island zone and for detecting vehicle movement in approach zones.

Yet a further object of this invention is to provide a unique motion detection system for a railway grade crossing employed by a transmitter directly connected to the track rails and having a receiver inductively coupled to the track rails.

Still another object of this invention is to provide a train detector for a railroad highway crossing comprising a transmitter center-feeding a.c. signals to the track rails, and a receiver including at least a pair of coils located on either side of the crossing and disposed adjacent the track rails for defining an island zone and for picking up a.c. signals when the island zone is unoccupied.

Still a further object of this invention is to provide an improved motion warning device which is economical in cost, durable in use, reliable in service, efficient in operation, and simple in design.

SUMMARY OF THE INVENTION

In accordance with the present invention, the railroad highway grade crossing warning system includes a transmitter directly connected to the rails of the track circuit and a receiver inductively coupled to the track rails. The transmitter includes solid-state oscillating amplifying and filtering circuits for producing a.c. voltage signals which are center-fed to the track rails. The receiver includes a pair of pickup coils disposed adjacent the track rails and located on opposite sides of the highway crossing for defining an island zone. A pair of shunt impedances are connected between the track rails at distant locations on either side of the island zone to establish approach zones. Each of the pair of pickup coils is connected to receiver sections including filtering, impedance calculating, code detecting, and microcomputing hardware for monitoring the condition of the track circuit. The pickup coils sense the amount of current flowing in the respective zones which, in turn, induce a proportional amount of voltage into the pickup coils. The picked up voltage signals are filtered and fed to an impedance calculator along with a filtered reference voltage to determine the track impedance. When a train enters the approach zone, the induced voltage increases as the train approaches the highway crossing. Thus, the picked up voltage which is proportional to track impedance is calculated and fed to the microcomputer which samples and predicts the time of arrival of the train. When the train is within approximately twenty seconds away from the highway crossing, the microcomputer in the receiver causes the crossing control equipment to de-energize a vital relay which results in the activation of the warning lights and bell and/or in the lowering of the highway crossing gates to alert the pedestrians and motorists of the approaching train. Now, when the train passes the pickup coil at the beginning of the island zone, the voltage in the pickup coil goes from a maximum level to a zero value to ensure positive protection to the general public. That is, since no voltage is induced into the pickup coil, the receiver and, particularly, the microcomputer, positively ensures that the warning devices are not deactivated as long as the train is in the island zone. Now, when the train exits the island zone and the last axle and wheels pass the exit pickup coil, the voltage instantaneously goes from a zero value to a maximum level. The picked up voltage is filtered and the impedance is calculated. The calculated impedance is sampled by the microcomputer which produces an output to cause the crossing control equipment to reenergize the vital relay. The energization of the vital relay deactivates the warning devices which allow the pedestrian and motor traffic to cross the tracks as soon as a receding train clears the island zone.

DESCRIPTION OF THE DRAWING

The single FIGURE is a schematic circuit diagram illustrating a preferred embodiment of the highway crossing constant warning system of the present invention.

DETAILED DESCRIPTION OF THE INVENTION

Referring now to the single FIGURE of the drawing, there is shown a railroad highway crossing protection system for forewarning pedestrians and motorists of oncoming trains. As shown, a road or highway HC is intersected or crossed by a trackway TC which includes a pair of track rails 1 and 2. In order to provide the highest degree of protection to the general public, it is common practice to establish long-distance approach zones on either side of the highway crossing and to encompass the highway with an island zone. In practice, it is also highly desirable to provide a constant warning time to activate the warning signals, such as, sounding the bell, flashing the lights, and/or lowering the gates when a train or transit vehicle enters the approach zones. That is, the velocity of trains entering the approach zones may range from a maximum speed to a minimum speed so that the time of arrival may vary over a wide interval. Thus, in order to provide sufficient warning to motorists and pedestrians, it is necessary to discern the speed of an oncoming train in the approach zone to accurately predict its time of arrival at the highway crossing. The railroad grade crossing also includes an island zone which provides a positive protection area or section on either side of the highway HC. When a train or transit vehicle is within the bounds of an island zone, the warning apparatus is activated until such time as the last vehicle or train exits the island zone.

As shown, an a.c. transmitter 11 is connected to the track rails 1 and 2 in the island zone via conductive leads 12 and 13, respectively. The lumped ballast leakage resistance is illustrated by a phantom resistive or impedance element R which effectively limits the length of the approach zones of previous track circuits due to its loading effect. The use of salt and deicers on the roadway during winter and the buildup of mud increase the loading effectiveness of the lumped ballast leakage resistance. It will be seen that a pair of pickup coils CA and CB are disposed on either side of the roadway HC and are situated adjacent the track rail 2. It will be noted that the island zone is defined as the distance between the two coils CA and CB. Thus, the positioning of the two pickup coils may be shortened for single-lane, two-way traffic or lengthened for multiple-lane, two-way traffic. As shown, there are approach distances on either side of the highway HC to accommodate bidirectional train movement. The left-hand approach zone A is determined by the position of an a.c. shunt impedance ZA, and the right-hand approach zone B is determined by the position of an a.c. shunt impedance ZB. It will be appreciated that the lengths of the approach zones may be the same or the distances may be different depending on the layout of each particular railroad highway crossing. The a.c. shunts ZA and ZB are directly connected between the rails 1 and 2 by welding or the like.

Each of the a.c. shunts ZA and ZB is preferably a narrow band, sharply tuned, resonant circuit which is hard-wire-connected to the rails 1 and 2 when used in coded signal territory. It will be understood that in nonsignal territory, the shunts may be suitable wide band a.c. devices, such as, capacitors.

It will be noted that pickup coil CA is connected by leads 14 and 15 to section A of a receiver 16 while pickup coil CB is connected by leads 17 and 18 to section B of the receiver 16. As shown, a portion of the a.c. signals produced by transmitter 11 is fed by leads 19 and 20 to receiver sections A and B of receiver 16 for reference purposes. The output of receiver section A is fed by lead 21 to the input of crossing control apparatus 22 while the output of receiver section B is also fed by lead 23 to the input of crossing control apparatus 22. In the absence of a train in the approach and island zones, the crossing control apparatus 22 produces a signal on output lead 24 to a vital-type of electromagnetic relay 25 which causes the opening of the contacts in the power circuit for the lights, bell, and/or gate mechanism of the highway crossing. Thus, the energization of the vital relay 25 results in the de-energization of the highway crossing warning equipment during the unoccupancy of a train in the detection zones.

In practice, the transmitter 11 includes crystal controlled oscillating, solid-state, amplifying, and filtering circuits for providing voltage signals via leads 12 and 13 to the track rails. Also, voltage reference signals are conveyed by leads 19 and 20 from the transistorized transmitter 11 to the respective receiver sections A and B. The reference voltages fed to sections A and B have the same phase relationship and are proportional in magnitude to the voltage signals which are directly supplied to the track circuit. The voltage signals cause a current to flow in the track circuit so that a voltage is induced into each of the pickup coils CA and CB. The receiver sections are substantially identical and include separate filters, impedance calculators, a code detector, and a commonly shared microcomputer. The filters of the receiver section extract the frequency of the transmitted signals from the track so that they may be discerned from train control signals in coded territory. Thus, the filtered signals picked up by inductive coils CA and CB are fed to the impedance calculators so that the impedance of each approach zone is determined. The outputs from the impedance calculators are sampled by the microcomputer which detects motion and predicts the time of arrival of a train. However, the code detector responds to any periodic change in the track voltage as would be produced in coded track territory and inhibits the impedance calculator during a marked period. However, if no train is in either approach zone A or B, the microcomputer provides signals on leads 21 and 23 to the crossing control apparatus which energizes the vital relay via lead 24. Thus, the warning devices remain deactivated to allow the free flow of traffic across the highway grade crossing.

Let us now assume a train enters approach zone A at the point where shunt impedance ZA is connected across rails 1 and 2 of the track circuit. It will be appreciated that the track current will increase as the train moves further into the approach zone A so that the voltage induced into pickup coil CA proportionally increases. Thus, the track impedance is calculated from the ratio of the picked up voltage and the reference voltage fed to receiver section A to determine the speed and, in turn, the time of arrival of the train at the crossing. The microcomputer is programmed to remove the output signal on lead 21 when the train is approximately twenty (20) seconds from entering the island zone. Further, it will be seen that the track current continually increases as the train gets nearer the entrance of the island zone so that the voltage induced in pickup coil CA reaches a maximum value just prior to the front wheels of the train crossing the border line between the approach zone A and the island zone. Thus, picked up voltage goes from a maximum to a minimum value due to the short circuit of the front wheels when a train enters the island zone. It will be apparent that if the train or portion of the train stops within the island zone, the warning devices will remain continuously energized so long as the train is in the positive detection island zone due to the drop-away or release of vital relay 25. Now, as the rear of the train passes through the highway crossing, and when the last wheels cross the border line between the island zone and approach zone B, the voltage in pickup coil CB goes from a minimum value to a maximum level. Thus, a distinct and positive transition occurs when a train departs the island zone so that the reappearance of voltage in pickup coil CB causes the reenergization of relay 25 and results in the immediate deactivation of the warning devices. Accordingly, the ring-by distance is virtually reduced to zero since a clear line of demarcation exists as soon as the last vehicle axle exits the island zone so that traffic may proceed across the highway crossing as soon as a safe condition prevails. Hence, the general public is not inconvenienced by undue delays due to long ring-by distances as was common with conventional prior art crossing protection systems.

It will be appreciated that if the exiting train stops in the approach zone B, the impedance calculators and microcomputer will continue to cause the crossing control equipment to keep the relay 25 energized. However, if the exiting train stops and then reverses direction, the pickup coil CB will begin sensing an increase in the amplitude of the induced voltage which is fed to the impedance calculator of receiver section B. If and when the returning train is within the minimal twenty (20) seconds warning time of the highway crossing HC, the microcomputer will effectively cause the crossing control equipment 22 to de-energize relay 25 which, in turn, results in the activation of the warning devices, lights, bell, and gates. The warning devices will continue to be activated until the train again clears the island zone and enters approach zone A. If a following train enters approach zone B while an exiting train is still in approach zone A, the monitoring apparatus will sense the presence of the train in approach zone B since the induced voltage in pickup coil CB will change due to the shunting by the front wheels and axle. Again, when the train in approach zone B is within the twenty (20) seconds warning time, the impedance calculator and microcomputer will activate the warning devices by de-energizing relay 25. The following sequence of operation will be the same as that described above except the train will be moving from approach zone B through the island zone and then through approach zone A.

It will be appreciated that various changes, modifications, and alterations may be made by persons skilled in the art without departing from the spirit and scope of the present invention. Thus, it will be understood that certain variations may be made to the above-described invention and, therefore, it is intended that the subject invention be limited only as indicated by the scope of the appended claims.

Having now described the invention, what I claim as new and desire to secure by Letters Patent, is:

1. A train detector for a railroad highway crossing comprising, a transmitter center feeding a.c. signals to the track rails at the crossing, a remote shunt connected to the track rails on either side of the crossing to establish an approach zone, and a receiver including at least a pair of coils located between the crossing and each of said remote shunts and disposed adjacent the track rails for defining an island zone within said approach zones and for inductively picking up a.c. signals when the island zone is unoccupied.

2. The train detector, as defined in claim 1, wherein said transmitter is directly connected to the track rails by a pair of conductors.

3. The train detector, as defined in claim 1, wherein said receiver includes two sections, each of which is connected to a separate one of said pair of coils.

4. The train detector, as defined in claim 1, wherein said remote shunt is an a.c. shunt which is connected across the track rails to define the beginning of an approach zone.

5. The train detector, as defined in claim 4, wherein said pair of coils sense the amount of current flowing in the track rails and wherein the current in said pair of coils goes from a maximum value to a minimum value as an approaching train departs the approach zone and enters the island zone.

6. The train detector, as defined in claim 4, wherein said pair of coils sense the amount of current flowing in the track rails and wherein the current in said pair of coils goes from a minimum value to a maximum value as a departing train exits the island zone and enters the approach zone.

7. The train detector, as defined in claim 1, wherein said receiver includes a first section connected to one of said pair of coils and a second section connected to the other of said pair of coils.

8. The train detector, as defined in claim 1, wherein said remote shunt is a low impedance which is connected across the track rails at a remote location on either side of the crossing for defining approach zones wherein an approaching train results in the establishment of a constant warning time for controlling the warning apparatus.

9. The train detector, as defined in claim 1, wherein said pair of coils are separately connected to a pair of receiver sections, each of which is connected to highway crossing warning apparatus.

10. The train detector as defined in claim 1, wherein said receiver includes means for calculating the speed of an approaching train and for predicting the time of arrival of the train at the crossing in order to provide a constant warning time for controlling the warning apparatus.

* * * * *